US012232680B2

(12) United States Patent
Ohayon et al.

(10) Patent No.: US 12,232,680 B2
(45) Date of Patent: Feb. 25, 2025

(54) CLEAN DISH VERIFICATION USING A CAMERA ASSEMBLY IN A DISHWASHER APPLIANCE

(71) Applicant: Haier US Appliance Solutions, Inc., Wilmington, DE (US)

(72) Inventors: Tal Abraham Ohayon, Hollywood, FL (US); Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 300 days.

(21) Appl. No.: 17/894,454

(22) Filed: Aug. 24, 2022

(65) Prior Publication Data

US 2024/0065520 A1 Feb. 29, 2024

(51) Int. Cl.
*A47L 15/42* (2006.01)

(52) U.S. Cl.
CPC ..... *A47L 15/4295* (2013.01); *A47L 2401/04* (2013.01); *A47L 2501/26* (2013.01)

(58) Field of Classification Search
None
See application file for complete search history.

(56) References Cited

U.S. PATENT DOCUMENTS

| | | | |
|---|---|---|---|
| 5,229,573 | A | 7/1993 | Stone et al. |
| 8,696,827 | B2 | 4/2014 | Ashrafzadeh et al. |
| 10,080,477 | B2 | 9/2018 | Fauth et al. |
| 2016/0262594 | A1 | 9/2016 | Chan |
| 2019/0382941 | A1 | 12/2019 | Hwang et al. |
| 2020/0085275 | A1 | 3/2020 | Lee |
| 2020/0138263 | A1 | 5/2020 | Alemany et al. |
| 2021/0093154 | A1* | 4/2021 | Boyer ..... A47L 15/46 |

FOREIGN PATENT DOCUMENTS

| | | | |
|---|---|---|---|
| CN | 107865630 | B | 4/2018 |
| DE | 10048081 | A1 | 4/2002 |
| DE | 102018009311 | B4 | 5/2020 |
| EP | 3427630 | A1 | 1/2019 |

* cited by examiner

*Primary Examiner* — Rita P Adhlakha
(74) *Attorney, Agent, or Firm* — Dority & Manning, P.A.

(57) ABSTRACT

A dishwasher appliance includes a tub defining a wash chamber for receipt of a load of articles for washing, a door providing selective access to the wash chamber, and a camera assembly mounted with a view of the load of articles. A controller is configured to determine that a cleaning cycle has been completed, obtain a first image using the camera assembly, determine that the door has been opened, obtain a second image using the camera assembly, determine that a predetermined number of articles from the load of articles has been removed from the wash chamber based at least in part on the first image and the second image, and provide a user notification that the load of articles is dirty in response to determining that the predetermined number of articles has been removed from the wash chamber.

16 Claims, 4 Drawing Sheets

CLEAN DISH VERIFICATION USING A CAMERA ASSEMBLY IN A DISHWASHER APPLIANCE

FIELD OF THE INVENTION

The present disclosure relates generally to dishwasher appliances, and more particularly to a dishwasher appliance using a camera for determining the state of cleanliness of articles within the dishwasher appliance.

BACKGROUND OF THE INVENTION

Dishwasher appliances generally include rack assemblies for positioning various articles for cleaning within a wash chamber. One or more fluid delivery devices such as nozzles, spray arms, or spray assemblies may be included at various locations relative to the rack assemblies for purposes of delivering fluids as part of the cleaning process. To maintain such fluid within the wash chamber during a cleaning cycle, the appliance is typically provided with a door that can be selectively opened or closed by the user.

During the normal use of the dishwashing appliance, one or more fluid delivery devices provide wash fluid at locations within the appliance during the cleaning cycle. These locations may be at e.g., different levels within the appliance. The fluid delivery devices may provide for different patterns of spray, jets, or other streams of fluid based on location to increase the efficacy of the cleaning cycle. For example, one type of fluid delivery device might be used where silverware is expected to be positioned by the user and another type might be used where dishes or cooking utensils are expected.

After a wash cycle is complete, the cleaned articles may remain within the wash chamber as they are dried. Ideally, a user of dishwasher appliance will immediately empty all articles from the dishwasher after completion of the cleaning and/or drying cycle. However, articles are not commonly removed immediately, e.g., because the user is not near the appliance, does not currently need dishes, or is otherwise occupied. Notably, particularly in appliance settings where multiple consumers use the same dishwasher appliance, certain consumers may have a tendency to only remove dishes as they are needed. Similarly, other consumers may have a tendency to place dirty dishes into the wash chamber without first confirming whether the dishes remaining in the wash chamber are clean.

While conventional dishwashers may illuminate a light indicating that the load of dishes is clean, this light is commonly turned off after the dishwasher door is open under the assumption that the person accessing the wash chamber has removed all dishes. However, as noted above, this assumption is not always true. Accordingly, conventional dishwasher appliances currently do not provide the user with confidence as to the state of cleanliness of dishes within the wash chamber.

Accordingly, a dishwashing appliance that can determine whether dishes located within the wash chamber are clean would be beneficial. Such a dishwashing appliance that can also inform users as to the cleanliness of articles within the wash chamber at all times would be particularly useful.

BRIEF DESCRIPTION OF THE INVENTION

Aspects and advantages of the invention will be set forth in part in the following description, or may be apparent from the description, or may be learned through practice of the invention.

In one exemplary embodiment, a dishwasher appliance is provided including a tub defining a wash chamber for receipt of a load of articles for washing, the tub having a front opening, a door positioned adjacent to the tub at the front opening and configured for selectively moving between closed and open positions, one or more rack assemblies positioned within the wash chamber and configured for receipt of the load of articles, a fluid delivery device configured for delivering wash fluid into the wash chamber for cleaning the load of articles, a camera assembly mounted at the wash chamber with a view of the load of articles within the wash chamber, and a controller operably coupled with the camera assembly. The controller is configured to determine that a cleaning cycle has been completed, obtain a first image using the camera assembly, determine that the door has been opened, obtain a second image using the camera assembly, determine that a predetermined number of articles from the load of articles has been removed from the wash chamber based at least in part on the first image and the second image, and provide a user notification that the load of articles is dirty in response to determining that the predetermined number of articles has been removed from the wash chamber based at least in part on the first image and the second image.

In another exemplary embodiment, a method of operating a dishwasher appliance is provided. The dishwasher appliance includes a tub defining a wash chamber for receipt of a load of articles for washing, a door for providing selective access to the tub, and a camera assembly mounted with a view of the load of articles. The method includes determining that a cleaning cycle has been completed, obtaining a first image using the camera assembly, determining that the door has been opened, obtaining a second image using the camera assembly, determining that a predetermined number of articles from the load of articles has been removed from the wash chamber based at least in part on the first image and the second image, and providing a user notification that the load of articles is dirty in response to determining that the predetermined number of articles has been removed from the wash chamber based at least in part on the first image and the second image.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
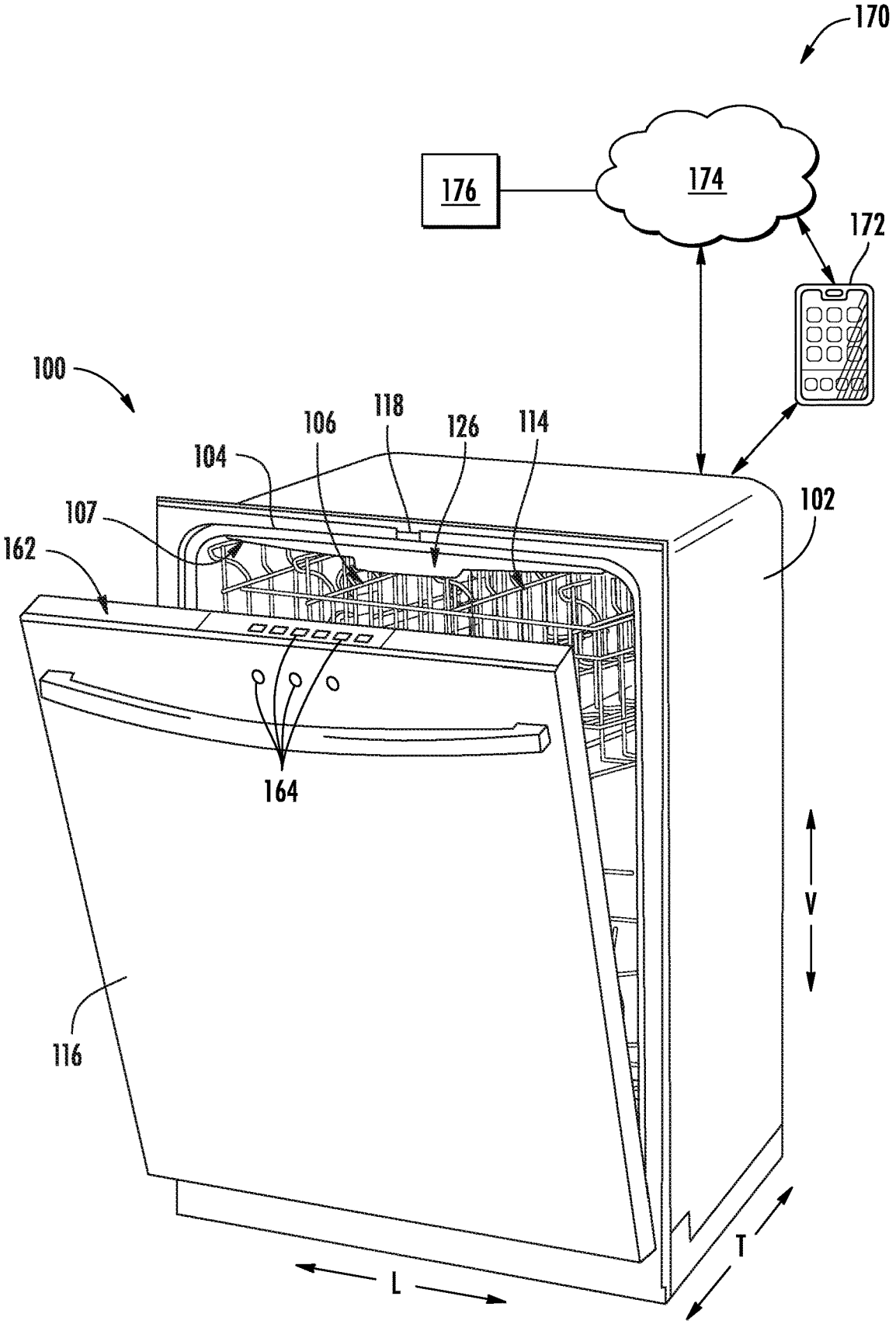
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "cleaning cycle" is intended to refer to one or more periods of time that may include a wash cycle, rinse cycle, and/or a drain cycle. The term "wash fluid" refers to a liquid used for washing and/or rinsing the articles and is typically made up of water that may include other additives such as detergent or other treatments.

Figure 2:
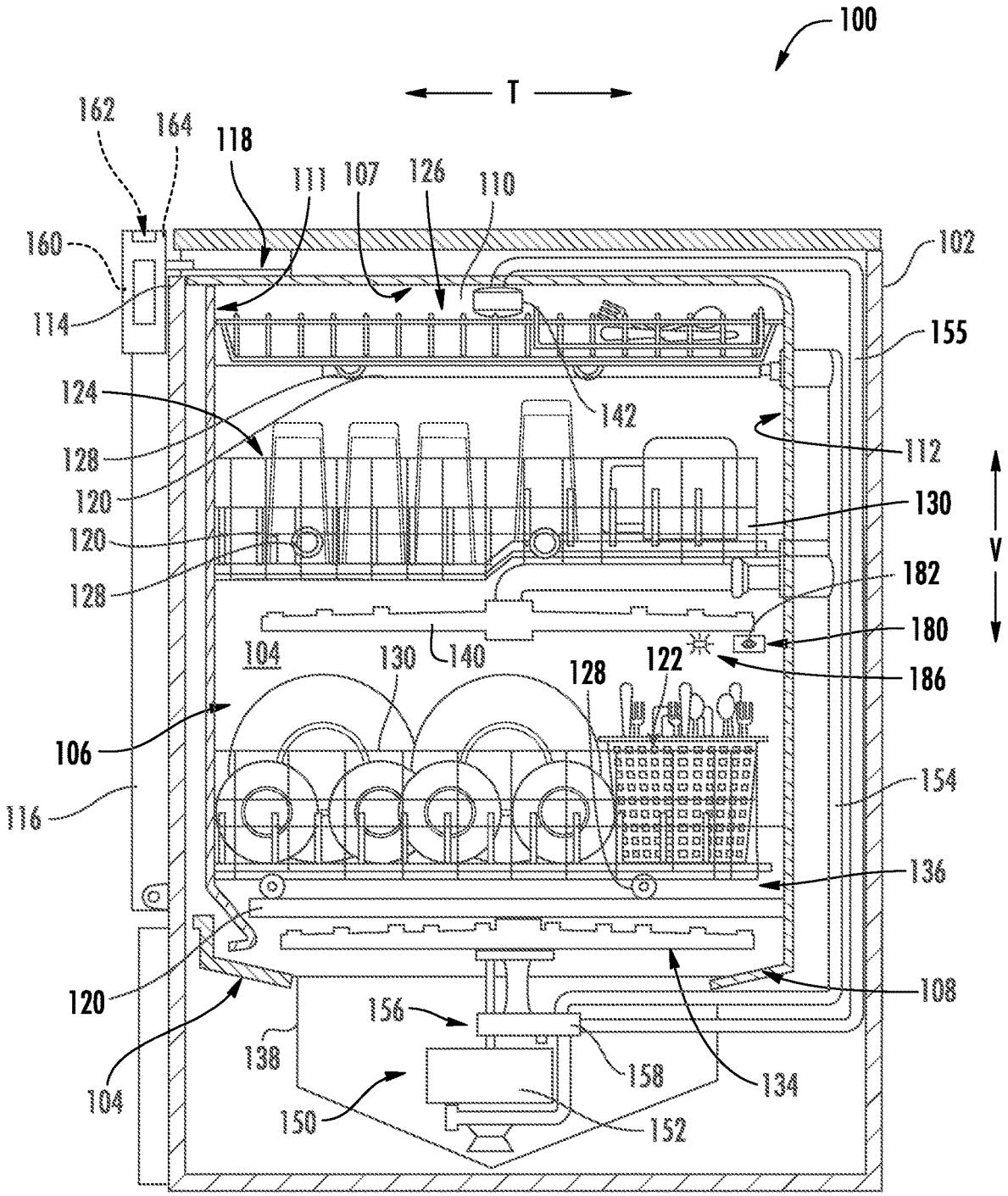
FIG. 2 provides a side, cross sectional view of the exemplary dishwashing appliance of FIG. 1 with the door in a closed position.

FIGS. 1 and 2 depict an exemplary domestic dishwasher or dishwasher appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal, fully open position for loading and unloading of articles from the dishwasher 100. A partially open position of door 116 are shown in FIG. 1. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a first rack assembly 122 (also referred to as a lower rack assembly 122), a middle rack assembly 124 (also referred to as a second rack assembly 124), and a third rack assembly 126 (also referred to as an upper rack assembly 126). As illustrated, third rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. For this embodiment, a silverware basket (not labeled) may be removably attached to a rack assembly, e.g., lower rack assembly 122, for placement of silverware, utensils, and the like, that are otherwise too small or delicate to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a first spray assembly 134 (also referred to as a lower spray arm assembly 134) disposed in a lower region 136 of wash chamber 106 and above a sump 138 so as to rotate in relatively close proximity to lower rack assembly 122. Similarly, a second spray assembly 140 (also referred to as a mid-level spray arm assembly 140) is located in an upper region of wash chamber 106 and may be located below and in close proximity to middle rack assembly 124. In this regard, mid-level spray arm assembly 140 may generally be configured for urging a flow of wash fluid up through middle rack assembly 124 and third rack assembly 126. Additionally, a third spray assembly 142 (also referred to as an upper spray assembly 142) may be located above third rack assembly 126 along the vertical direction V. In this manner, third spray assembly 142 may be configured for urging and/or cascading a flow of wash fluid downward over rack assemblies 122, 124, and 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to mid-level spray arm assembly 140. In addition, a separate secondary supply conduit 155 may supply wash fluid to upper spray assembly 142. Diverter assembly 156 can allow selection between spray assemblies 134, 140 and 142 being supplied with wash fluid. However, it should be appreciated that according to alternative embodiments, any other suitable plumbing configuration may be used to supply wash fluid throughout the various spray manifolds and assemblies described herein.

Each spray assembly 134, 140, 142 or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray assemblies 134, 140, 142 may be motor-driven, or may operate using any other suitable drive mechanism. Spray manifolds and assemblies may also be stationary.

Movement of the spray arm assemblies 134 and 140 and the spray from fixed manifolds like spray assembly 142 provides coverage of dishes, silverware, and other dishwasher contents and articles to be cleaned with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which (e.g., 154 and 155) are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counterclockwise direction, a third conduit for spraying rack assembly 126 (shown in FIG. 2) as a silverware rack, and a fourth conduit for supplying only mid-level and/or upper spray assemblies 140, 142. Other configurations of diverter assembly 156 and/or other components (e.g., valves) may be used to allow various choices in the operation of the spray assemblies 134, 140, and 142 during a cleaning cycle.

The dishwasher 100 is further equipped with a controller 160 to regulate operation of the dishwasher 100. Controller 160 may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray assemblies 134, 140, 142 and spray manifold configurations may be used, and other differences may be applied while remaining within the scope of the present subject matter.

Dishwasher 100 may also be configured to communicate wirelessly with a cloud-server that may include a database or may be, e.g., a cloud-based data storage system and may also include image recognition and processing capabilities including artificial intelligence as further described below. For example, appliance 100 may communicate with cloud-server over the Internet, and appliance 100 may access via WI-FI®, such as from a WI-FI® access point in a user's home or through a mobile device. Alternatively, dishwasher 100 may be equipped with such image recognition and processing capabilities as part of controller 160 and/or other components onboard appliance 100.

In this regard, referring still to FIG. 1, a schematic diagram of an external communication system 170 will be described according to an exemplary embodiment of the present subject matter. In general, external communication system 170 is configured for permitting interaction, data transfer, and other communications between dishwasher appliance 100 and one or more external devices. For example, this communication may be used to provide and receive operating parameters, user instructions or notifications, performance characteristics, user preferences, or any other suitable information for improved performance of dishwasher appliance 100. In addition, it should be appreciated that external communication system 170 may be used to transfer data or other information to improve performance of one or more external devices or appliances and/or improve user interaction with such devices.

For example, external communication system 170 permits controller 160 of dishwasher appliance 100 to communicate with a separate device external to dishwasher appliance 100, referred to generally herein as an external device 172. As described in more detail below, these communications may be facilitated using a wired or wireless connection, such as via a network 174. In general, external device 172 may be any suitable device separate from dishwasher appliance 100 that is configured to provide and/or receive communications, information, data, or commands from a user. In this regard, external device 172 may be, for example, a personal phone, a smartphone, a tablet, a laptop or personal computer, a wearable device, a smart home system, or another mobile or remote device.

In addition, a remote server 176 may be in communication with dishwasher appliance 100 and/or external device 172 through network 174. In this regard, for example, remote server 176 may be a cloud-based server 176, and is thus located at a distant location, such as in a separate state, country, etc. According to an exemplary embodiment, external device 172 may communicate with a remote server 176 over network 174, such as the Internet, to transmit/receive data or information, provide user inputs, receive user notifications or instructions, interact with or control dishwasher appliance 100, etc. In addition, external device 172 and remote server 176 may communicate with dishwasher appliance 100 to communicate similar information.

In general, communication between dishwasher appliance 100, external device 172, remote server 176, and/or other user devices or appliances may be carried using any type of wired or wireless connection and using any suitable type of communication network, non-limiting examples of which are provided below. For example, external device 172 may be in direct or indirect communication with dishwasher appliance 100 through any suitable wired or wireless communication connections or interfaces, such as network 174. For example, network 174 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Figure 4:
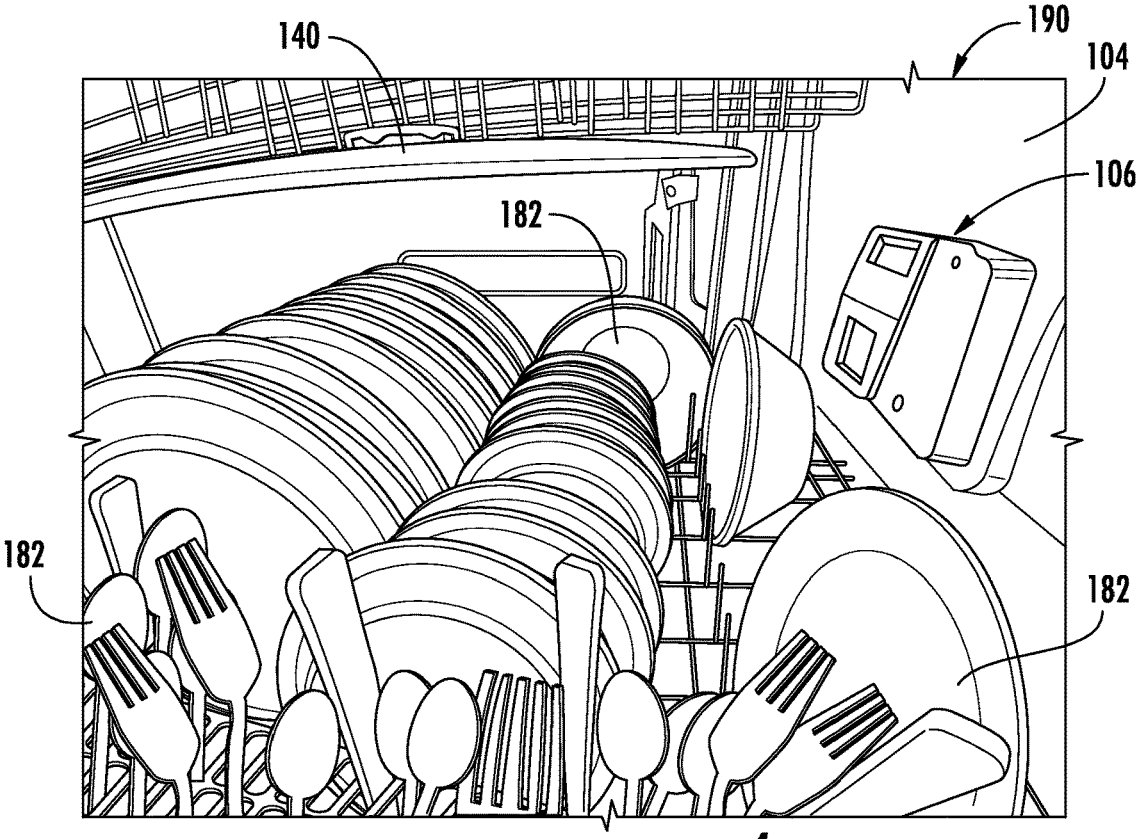
FIG. 4 provides an image obtained using a camera of a dishwasher appliance when the dishes are clean according to an exemplary embodiment of the present subject matter.
Figure 5:
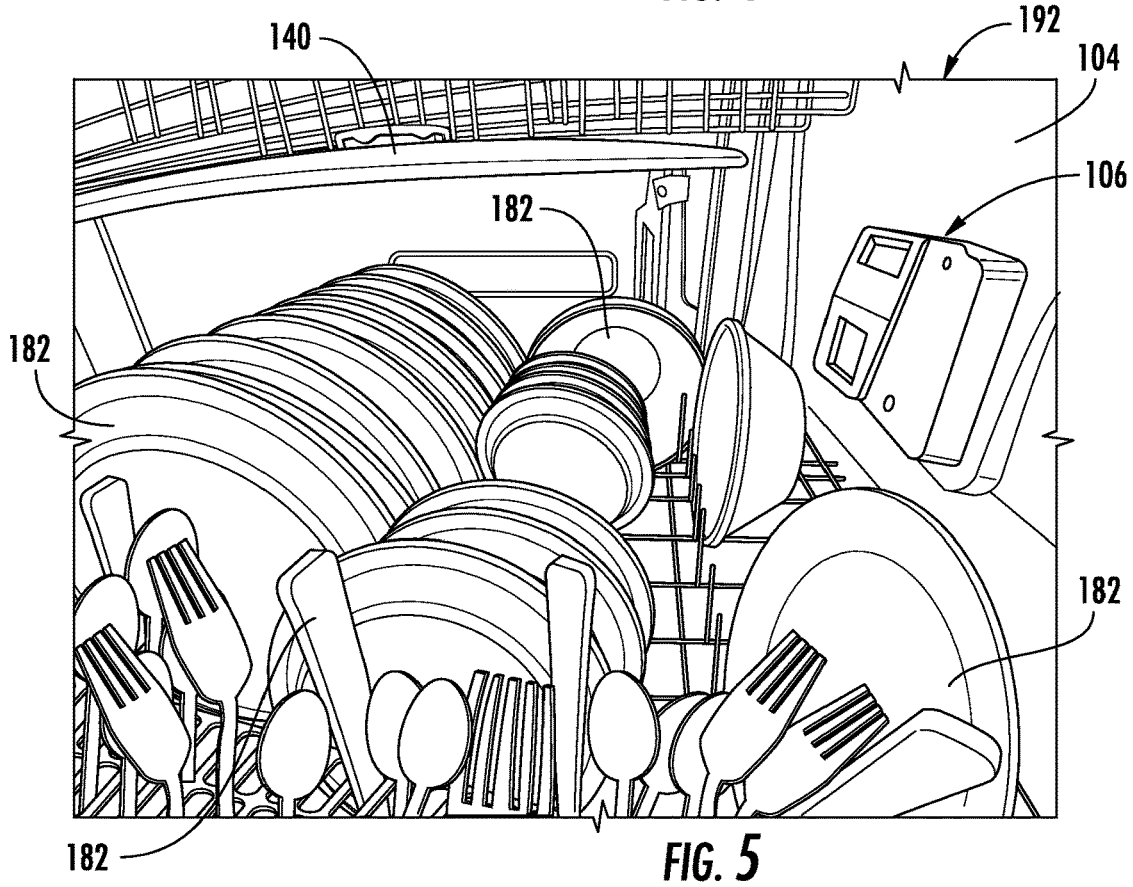
FIG. 5 provides an image obtained using the exemplary camera of FIG. 4 after clean dishes have been removed according to an exemplary embodiment of the present subject matter.

Dishwasher 100 includes a camera assembly or other optical sensor assembly 180, which may be positioned along one of the sidewalls 110. For this exemplary embodiment, camera assembly 180 includes a sensor 182 (e.g., a camera) for obtaining images within wash chamber 106 and particularly images that can be used to monitor the load of articles positioned within the wash chamber 106. Specifically, as best shown in FIGS. 4 and 5, the load of articles generally includes one or more objects, articles, dishware, utensils, etc. (e.g., identified generally by reference numeral 184). In other embodiments, camera assembly 180 may be positioned so that it has a view of another desired location in, or desired portion of, wash chamber 106. Thus, although shown on one of the sidewalls 110 near door 116, camera assembly 180 could be placed at other locations along sidewalls 110, rear wall 112, or even door 116 provided such placement allows for a view and resulting capture of an image from which the articles 184 within wash chamber 106 may be monitored.

Camera assembly 180 may include any suitable number, type, size, and configuration of camera(s) 182 for obtaining images in wash chamber 106. In general, camera(s) 182 may include a lens that is constructed from a clear hydrophobic material or which may otherwise be positioned behind a hydrophobic clear lens. So positioned, camera assembly 180 may obtain one or more images or videos of articles and/or rack assemblies within wash chamber 106, as described in more detail below. For the exemplary embodiment of FIG. 2, camera assembly 180 is positioned in view of first rack assembly 122 where a silverware basket would normally be located. However, camera assembly 180 may have any other suitable field of view while remaining within the scope of the present subject matter.

Referring still to FIG. 2, dishwasher appliance 100 may further include one or more wash chamber lights 186 positioned within cabinet 102 or wash chamber 106 for selectively illuminating wash chamber 106, the articles 184 positioned therein, etc. Specifically, light 186 may be separate from camera assembly 180 or may be integrated into camera assembly 180. In one embodiment, light 186 is positioned immediately adjacent camera assembly 180. According to still other embodiments, light 186 may be positioned at any other suitable location within cabinet 102. It should be appreciated that according to alternative embodiments, dishwasher appliance 100 may include any other camera or system of imaging devices for obtaining images to monitor the articles 184 within wash chamber 106. In addition, these cameras may be positioned at any suitable location within cabinet 102, may include any suitable lighting features, and may utilize any suitable photography or imaging technology.

Notably, controller 160 of dishwasher appliance 100 (or any other suitable dedicated controller) may be communicatively or operably coupled to camera assembly 180, camera 182, tub light 186, and/or other components of appliance 100. As explained in more detail below, controller 160 may be programmed or configured for analyzing the images obtained by camera assembly 180, e.g., in order to monitor the articles 184 as they are being added to or removed from wash chamber 106 and may use this information to make informed decisions regarding the whether the load of articles is clean or dirty. Alternatively, such images from camera assembly 180 may be transmitted or uploaded to e.g., a cloud-server or cloud-based system (e.g., remote server 176) for further processing of such information as will also be further described. The images may also be electronically stored by dishwasher appliance 100 as part of the process by which dishwasher appliance 100 utilizes the same to monitor the load of articles 184.

Figure 3:
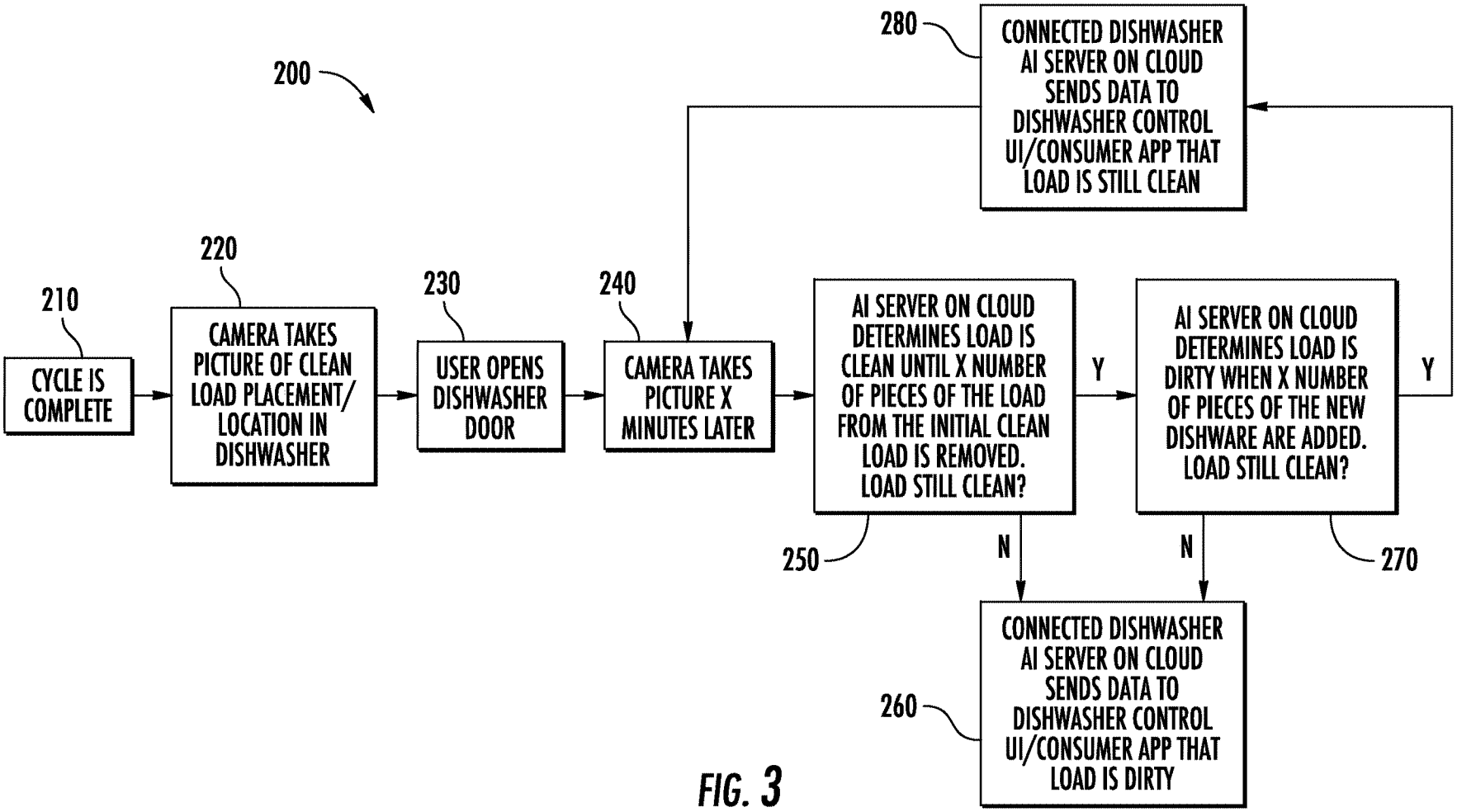
FIG. 3 provides a method for operating a dishwasher appliance and camera assembly according to an exemplary embodiment of the present subject matter.

Referring now to FIG. 3, an exemplary method 200 of operating a dishwashing appliance such as dishwasher appliance 100 will be described. Although the discussion below refers to the exemplary method 200 of operating appliance 100, one skilled in the art will appreciate that the exemplary method 200 is applicable to the operation of a variety of other dishwashing appliances having different configurations and equipment and that the steps disclosed herein may be performed by e.g., controller 160 in whole, or in part, and in conjunction with one or more separate systems including cloud-based systems. Reference to a "step" or other action does not prevent such from being performed in a series of steps or multiple actions unless otherwise stated and does mean such step is necessarily required in all exemplary aspects of the present invention. The order of such steps or actions may also be altered unless otherwise stated.

In step 210, method 200 includes determining that a cleaning cycle has been completed within a dishwasher appliance. In this regard, continuing the example from above, after dishwasher appliance 100 has completed a cleaning cycle, all articles 184 within wash chamber 106 may be presumed clean. As explained in more detail below aspects of the present subject matter are generally directed to methods for monitoring and maintaining improved knowledge regarding the state of cleanliness of articles 184 after a wash cycle (e.g., whether articles 184 may or may not include dirt, soil, grime, etc.).

Method 200 may further include, at step 220, obtaining a first image using a camera assembly mounted within a wash chamber of the dishwasher appliance. In this regard, continuing the example from above, camera assembly 180 may be used to obtain a first image (e.g., identified generally by reference numeral 190 in FIG. 4). In general, the first image 190 is intended to capture the state of wash chamber 106 and all articles 184 located therein immediately following the performance of a cleaning cycle and before door 116 has been opened. In other words, the first image 190 captures the load of articles 184 in the "clean" state.

Step 230 includes determining that the door of the dishwasher appliance has been opened. In this regard, continuing the example from above controller 160 may be in operative communication with the door closure assembly 118 (which may include a door sensor). This door closure assembly 118 may be used to monitor the position of door 116, e.g., whether door 116 is in the closed position or the open position. Accordingly, step 230 of determining that the door has been opened may include determining that the door sensor of door closure assembly 118 has been triggered. According to still other embodiments, camera assembly 180 may be used to monitor motion within wash chamber 106. In this regard, when camera assembly 180 detects motion within wash chamber 106, controller 160 may determine that door 116 has been opened. Notably, method 200 may utilize various other sensors, devices, and methods for determining that the door has been opened while remaining within the scope of the present subject matter.

After the door has been opened at step 230, step 240 may include obtaining a second image of the wash chamber using the camera assembly. In this regard, camera assembly 180 may obtain a second image 192 as best shown in FIG. 5. As will be explained in more detail below, method 200 may include comparing first image 190, second image 192, and/or additional images in order to determine whether the load of articles 184 should be reported as clean or dirty. More specifically, starting from the assumed state of a clean load of articles 184 as captured in the first image 190, method 200 includes determining whether there is a change in the articles 184 within wash chamber 106 sufficient to justify a determination that the entire load is dirty.

As used herein, "image" includes a single photograph or representation (e.g., a digital or electronic file) of the view of camera assembly 180, multiple such photographs or representations, and/or videos from which image processing can be performed to monitor articles 184 within wash chamber 106. Although two consecutive images are illustrated in each figure, it should be appreciated that any suitable number of images may be used while remaining within the scope of the present subject matter. Moreover, these images may be obtained with or without light 186, from any suitable position of camera 182, at any suitable frequency and resolution, etc. As explained herein, aspects of the present subject matter are generally directed toward the use of such obtained images to determine whether articles 184 have been added to and/or removed from wash chamber 106 after the completion of the cleaning cycle.

Notably, when the door is open after a cleaning cycle is complete, it is possible that a user of dishwasher appliance 100 is in the process of emptying all clean dishes from wash chamber 106. Accordingly, in order to provide time for the unloading process to occur, obtaining the second image may include delaying for a predetermined amount of time after the door has been opened and before obtaining second image 192. In this regard, for example, the predetermined amount of time between the opening of the door and the obtaining of the second image may be between about 30 seconds and 20 minutes, between about 1 and 10 minutes, or about 5 minutes.

After the second image 192 is obtained, method 200 may include, at step 250, determining that a predetermined number of articles from the load of articles has been removed from the wash chamber based at least in part on the first image and the second image. In this regard, for example, step 250 may generally include the performance of analysis on the first image 190 and second image 192 to determine the number and/or type of articles 184 removed from the wash chamber 106. According to example embodiments, if this number of removed articles exceeds some predetermined threshold, the remainder of the dishes are presumed to be dirty. It should be appreciated that this analysis and counting of the number of articles removed may include any suitable image processing technique or image analysis. For example, according to an example embodiment, determining the predetermined number of articles that have been removed from the wash chamber may include comparing the first image and the second image, e.g., by performing a pixel-by-pixel comparison and associating pixel changes with the removal of one or more articles 184.

According to example embodiments, step 250 generally includes uploading the images obtained at steps 220, 240 (e.g., one or more of images 190, 192) to an artificial intelligence ("AI") server or module on the cloud or a dedicated module located within dishwasher appliance 100 (e.g., on controller 160). In this regard, controller 160 may obtain the first image 190 and second image 192 using camera assembly 180 and may either analyze those images using an on-board AI module or may offload such analysis to a remote module. This remote module may be located elsewhere within dishwasher appliance 100 or remote from appliance (e.g., on remote server 176). The remainder of the discussion of method 200 refers to image analysis being performed on the cloud (e.g., on remote server 176). However, it should be appreciated that this analysis could alternatively be performed locally on the dishwasher appliance 100 or at any other suitable location.

Specifically, the analysis performed by the AI module of the one or more images may include implementation an image processing algorithm. As used herein, the terms "image processing" and the like are generally intended to refer to any suitable methods or algorithms for analyzing images that do not rely on artificial intelligence or machine learning techniques (e.g., in contrast to the machine learning image recognition processes described below). For example, the image processing algorithm may rely on image differentiation, e.g., such as a pixel-by-pixel comparison of two sequential images. This comparison may help identify substantial differences between the sequentially obtained images, e.g., to identify movement, the presence of a particular object, the existence of a certain condition, etc. For example, one or more reference images may be obtained when a particular condition exists, and these references images may be stored for future comparison with images obtained during appliance operation. Similarities and/or differences between the reference image and the obtained image may be used to extract useful information for improving appliance performance.

According to exemplary embodiments, image processing may include blur detection algorithms that are generally intended to compute, measure, or otherwise determine the amount of blur in an image. For example, these blur detection algorithms may rely on focus measure operators, the Fast Fourier Transform along with examination of the frequency distributions, determining the variance of a Laplacian operator, or any other methods of blur detection known by those having ordinary skill in the art. In addition, or alternatively, the image processing algorithms may use other suitable techniques for recognizing or identifying items or objects, such as edge matching or detection, divide-and-conquer searching, greyscale matching, histograms of receptive field responses, or another suitable routine (e.g., executed at the controller 160 based on one or more captured images from one or more cameras). Other image processing techniques are possible and within the scope of the present subject matter. The processing algorithm may further include measures for isolating or eliminating noise in the image comparison, e.g., due to image resolution, data transmission errors, inconsistent lighting, or other imaging errors. By eliminating such noise, the image processing algorithms may improve accurate object detection, avoid erroneous object detection, and isolate the important object, region, or pattern within an image.

In addition to the image processing techniques described above, the image analysis may include utilizing artificial intelligence ("AI"), such as a machine learning image recognition process, a neural network classification module, any other suitable artificial intelligence (AI) technique, and/or any other suitable image analysis techniques, examples of which will be described in more detail below. Moreover, each of the exemplary image analysis or evaluation processes described below may be used independently, collectively, or interchangeably to extract detailed information regarding the images being analyzed to facilitate performance of one or more methods described herein or to otherwise improve appliance operation. According to exemplary embodiments, any suitable number and combination of image processing, image recognition, or other image analysis techniques may be used to obtain an accurate analysis of the obtained images.

In this regard, the image recognition process may use any suitable artificial intelligence technique, for example, any suitable machine learning technique, or for example, any suitable deep learning technique. According to an exemplary embodiment, the image recognition process may include the implementation of a form of image recognition called region based convolutional neural network ("R-CNN") image recognition. Generally speaking, R-CNN may include taking an input image and extracting region proposals that include a potential object or region of an image. In this regard, a "region proposal" may be one or more regions in an image that could belong to a particular object or may include adjacent regions that share common pixel characteristics. A convolutional neural network is then used to compute features from the region proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like, as opposed to a regular R-CNN architecture. For example, mask R-CNN may be based on fast R-CNN which is slightly different than R-CNN. For example, R-CNN first applies a convolutional neural network ("CNN") and then allocates it to zone recommendations on the covn5 property map instead of the initially split into zone recommendations. In addition, according to exemplary embodiments, standard CNN may be used to obtain, identify, or detect any other qualitative or quantitative data related to one or more objects or regions within the one or more images. In addition, a K-means algorithm may be used.

According to still other embodiments, the image recognition process may use any other suitable neural network process while remaining within the scope of the present subject matter. For example, the step of analyzing the one or more images may include using a deep belief network ("DBN") image recognition process. A DBN image recognition process may generally include stacking many individual unsupervised networks that use each network's hidden layer as the input for the next layer. According to still other embodiments, the step of analyzing one or more images may include the implementation of a deep neural network ("DNN") image recognition process, which generally includes the use of a neural network (computing systems inspired by the biological neural networks) with multiple layers between input and output. Other suitable image recognition processes, neural network processes, artificial intelligence analysis techniques, and combinations of the above described or other known methods may be used while remaining within the scope of the present subject matter.

In addition, it should be appreciated that various transfer techniques may be used but use of such techniques is not required. If using transfer techniques learning, a neural network architecture may be pretrained such as VGG16/VGG19/ResNet50 with a public dataset then the last layer may be retrained with an appliance specific dataset. In addition, or alternatively, the image recognition process may include detection of certain conditions based on comparison of initial conditions, may rely on image subtraction techniques, image stacking techniques, image concatenation, etc. For example, the subtracted image may be used to train a neural network with multiple classes for future comparison and image classification.

It should be appreciated that the machine learning image recognition models may be actively trained by the appliance with images (e.g., baseline images), may be supplied with training data from the manufacturer or from another remote source, or may be trained in any other suitable manner. For example, according to exemplary embodiments, this image recognition process relies at least in part on a neural network trained with a plurality of images of the appliance in different configurations, experiencing different conditions, or being interacted with in different manners. This training data may be stored locally or remotely and may be communicated to a remote server for training other appliances and models. According to exemplary embodiments, it should be appreciated that the machine learning models may include supervised and/or unsupervised models and methods. In this regard, for example, supervised machine learning methods (e.g., such as targeted machine learning) may help identify problems, anomalies, or other occurrences which have been identified and trained into the model. By contrast, unsupervised machine learning methods may be used to detect clusters of potential failures, similarities among data, event patterns, abnormal concentrations of a phenomenon, etc.

It should be appreciated that image processing and machine learning image recognition processes may be used together to facilitate improved image analysis, object detection, or to extract other useful qualitative or quantitative data or information from the one or more images that may be used to improve the operation or performance of the appliance. Indeed, the methods described herein may use any or all of these techniques interchangeably to improve image analysis process and facilitate improved appliance performance and consumer satisfaction. The image processing algorithms and machine learning image recognition processes described herein are only exemplary and are not intended to limit the scope of the present subject matter in any manner.

Step 250 may include a determination as to whether the load is still clean. For example, according to example embodiments, the output of the AI module comparison is a direct determination of whether the load is dirty or clean. According to still other embodiments, the output of the analysis may include a number of articles that have been removed. According to such an embodiment, the load may be considered dirty if the number of articles removed exceeds some predetermined threshold. For example, the predetermined threshold beyond which a load of articles is considered dirty may be between about 1 and 10 articles, between about 2 and 5 articles, or about 4 articles. It should be appreciated that the number of articles that need to be removed for a load of articles to be considered dirty may be set by the manufacturer, may be programmed by the user, or may be determined and input into the control logic in any other suitable manner.

As shown, if step 250 results in a determination that the predetermined number of articles has been removed from the wash chamber, step 260 may include providing a user notification that the load of articles is dirty in response to determining that the predetermined number of articles has been removed from the wash chamber based at least in part on the first image and the second image. In this regard, for example, user notifications as described herein may be provided in any suitable manner, such as by illuminating a load status indicator (e.g., via control panel 162) or providing some other suitable indication on an appliance display. According to still other embodiments, the user notification may be provided directly to the user through a remote device 172 (e.g., such as through a software application on the user's cell phone) over network 174. According to exemplary embodiments, this user notification may provide a user with a load status (e.g., clean or dirty) along with first image 190, second image 192, graphical indications of the location where articles 184 were removed or added to wash chamber 106, etc.

By contrast, if step 250 results in a determination that the number of articles removed has not exceeded the threshold or that the load of articles remains clean, method 200 may proceed to step 270 which includes determining whether a new article has been added to the wash chamber based at least in part on the first image and the second image. In this regard, based on the same analysis performed above with respect to the first image 190 and second image 192 to determine a number of articles removed from wash chamber 106, step 270 may include determining that any article has been added to wash chamber, and this may result in the determination that the load of articles is dirty. Accordingly, if an item is added, method 200 may proceed again to step 260 where user notification is provided that the load of articles is dirty.

By contrast, if step 270 results in a determination that no new articles were added to the wash chamber, method 200 may proceed to step 280 which includes providing a user notification that the load of articles 184 is still clean. At this point, method 200 may proceed back to step 240 where an additional image (e.g., third image or additional subsequent images) is obtained using the camera assembly and compared to the first image 190 and/or second image 192 in the same manner described above until it is determined that the load is dirty or that all articles 184 have been removed from wash chamber 106. Accordingly, method 200 may generally include monitoring the wash chamber 106 and determining that the load of articles positioned therein is dirty if either a certain number of dishes have been removed or if a single dish is added to the load of articles after they have been cleaned.

FIG. 3 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using dishwasher appliance 100 as an example, it should be appreciated that this method may be applied to the operation of any suitable dishwasher appliance.

As explained herein, aspects of the present subject matter are generally directed toward identifying if the load in a dishwasher is clean or dirty after the door opens or a cycle is completed. This identification may be achieved, for example, using a camera and utilizing an artificial intelligence (AI) image recognition/processing technology.

According to an example embodiment, the process of identifying that the load in a dishwasher is clean/dirty uses images obtained using a camera when the user removes one or more articles from an initially clean load. These images may be analyzed an AI module stored on the unit or in the cloud. Specifically, after completion of a cleaning cycle, the camera may take an image of the clean load of dishes within the wash chamber. After a consumer opens the dishwasher door (presumably to remove a single dish or unload the entire dishwasher), the camera may wait a predetermined amount of time and obtain another image. This second image may be analyzed using the AI module to determine how much of the load of dishes was removed. The load of dishes may be presumed clean if less than a predetermined portion of the load has been removed and may be presumed dirty if more than a predetermined portion of the load has been removed. The AI module may then communicate with the dishwasher controller or a user's remote device to communicate the state of cleanliness of the dishes remaining within the wash chamber, e.g., based on the number of pieces in the dishwasher.

According to another example embodiment, the process of identifying that the load in a dishwasher is clean/dirty uses images obtained using a camera when the user adds one or more articles from an initially clean load. These images may be analyzed an AI module stored on the unit or in the cloud. Specifically, after completion of a cleaning cycle, the camera may take an image of the clean load of dishes within the wash chamber. After a consumer opens the dishwasher door, the camera may wait a predetermined amount of time and obtain another image. This second image may be analyzed using the AI module to determine whether any dishes were added to the load or how many dishes were added to the load. The load of dishes may be presumed dirty if any dishes were added or when a predetermined number of new dishes were added. The AI module may then communicate with the dishwasher controller or a user's remote device to communicate the state of cleanliness of the dishes remaining within the wash chamber, e.g., based on the number of new pieces added to the dishwasher.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber for receipt of a load of articles for washing, the tub having a front opening;

a door positioned adjacent to the tub at the front opening and configured for selectively moving between closed and open positions;

one or more rack assemblies positioned within the wash chamber and configured for receipt of the load of articles;

a fluid delivery device configured for delivering wash fluid into the wash chamber for cleaning the load of articles;

a camera assembly mounted at the wash chamber with a view of the load of articles within the wash chamber; and a controller operably coupled with the camera assembly, the controller configured to:

determine that a cleaning cycle has been completed;

obtain a first image using the camera assembly;

determine that the door has been opened;

obtain a second image using the camera assembly;

determine that a predetermined number of articles from the load of articles has been removed from the wash chamber based at least in part on the first image and the second image; and provide a user notification that the load of articles is dirty in response to determining that the predetermined number of articles has been removed from the wash chamber based at least in part on the first image and the second image.

2. The dishwasher appliance of claim 1, wherein obtaining the second image comprises delaying for a predetermined amount of time after the door has been opened before obtaining the second image.

3. The dishwasher appliance of claim 2, wherein the predetermined amount of time is between about 1 and 10 minutes.

4. The dishwasher appliance of claim 1, wherein determining that the predetermined number of articles has been removed from the wash chamber comprises:

comparing the first image and the second image using an image processing technique.

5. The dishwasher appliance of claim 1, wherein determining that the predetermined number of articles has been removed from the wash chamber comprises:

analyzing the first image and the second image using a machine learning image recognition process.

6. The dishwasher appliance of claim 5, wherein the machine learning image recognition process comprises at least one of a convolution neural network ("CNN"), a region-based convolution neural network ("R-CNN"), a deep belief network ("DBN"), or a deep neural network ("DNN") image recognition process.

7. The dishwasher appliance of claim 1, wherein predetermined number of articles is determined by a manufacturer or set by a user of the dishwasher appliance.

8. The dishwasher appliance of claim 1, wherein the predetermined number of articles is between 1 and 10 items.

9. The dishwasher appliance of claim 1, wherein the controller is further configured to:

determine that the predetermined number of articles from the load of articles has not been removed from the wash chamber based at least in part on the first image and the second image; and provide a user notification that the load of articles is clean in response to determining that the predetermined number of articles has not been removed from the wash chamber based at least in part on the first image and the second image.

10. The dishwasher appliance of claim 9, wherein the controller is further configured to:

obtain a third image using the camera assembly;

determine that the predetermined number of articles from the load of articles has been removed from the wash chamber based at least in part on the first image and the third image; and provide the user notification that the load of articles is dirty in response to determining that the predetermined number of articles has been removed from the wash chamber based at least in part on the first image and the third image.

11. The dishwasher appliance of claim 1, further comprising:

a door sensor operably coupled to the door, and wherein determining that the door has been opened comprises detecting a trigger of the door sensor.

12. The dishwasher appliance of claim 1, wherein determining that the door has been opened comprises:

detecting motion within the wash chamber using the camera assembly.

13. The dishwasher appliance of claim 1, wherein the controller is further configured to:

determine that a new article has been added to the wash chamber based at least in part on the first image and the second image; and provide the user notification that the load of articles is dirty in response to determining that the new article has been added to the wash chamber based at least in part on the first image and the second image.

14. The dishwasher appliance of claim 1, wherein providing the user notification comprises:

illuminating a load status indicator on a user interface panel of the dishwasher appliance.

15. The dishwasher appliance of claim 1, wherein the controller is in operative communication with a remote device over a network, and wherein providing the user notification comprises:

providing the user notification to the remote device over the network.

16. The dishwasher appliance of claim 1, wherein the controller is further configured to cause the first image and the second image to be uploaded to or downloaded from a cloud-based server.

* * * * *